US009016063B2

(12) United States Patent
Gaia et al.

(10) Patent No.: US 9,016,063 B2
(45) Date of Patent: Apr. 28, 2015

(54) ORC PLANT WITH A SYSTEM FOR IMPROVING THE HEAT EXCHANGE BETWEEN THE SOURCE OF HOT FLUID AND THE WORKING FLUID

(75) Inventors: Mario Gaia, Brescia (IT); Roberto Bini, Brescia (IT)

(73) Assignee: Turboden S.R.L., Brescia (IT)

( * ) Notice: Subject to any disclaimer, the term of this patent is extended or adjusted under 35 U.S.C. 154(b) by 199 days.

(21) Appl. No.: 13/699,955

(22) PCT Filed: Jun. 9, 2011

(86) PCT No.: PCT/IT2011/000190

§ 371 (c)(1),
(2), (4) Date: Feb. 4, 2013

(87) PCT Pub. No.: WO2011/154983

PCT Pub. Date: Dec. 15, 2011

(65) Prior Publication Data

US 2013/0160448 A1 Jun. 27, 2013

(30) Foreign Application Priority Data

Jun. 10, 2010 (IT) ..... BS2010A0105

(51) Int. Cl.

| | |
|---|---|
| ***F01K 13/00*** | (2006.01) |
| ***F01K 25/08*** | (2006.01) |
| ***F01K 25/00*** | (2006.01) |
| ***F01K 7/40*** | (2006.01) |
| ***F01K 3/18*** | (2006.01) |
| *F03G 7/00* | (2006.01) |

(52) U.S. Cl.
CPC .. *F01K 3/18* (2013.01); *F01K 25/08* (2013.01)

(58) Field of Classification Search
USPC ..... 60/651, 671, 676
See application file for complete search history.

(56) References Cited

U.S. PATENT DOCUMENTS

| | | | | |
|---|---|---|---|---|
| 5,867,988 | A * | 2/1999 | Kaplan | 60/641.2 |
| 2010/0071368 | A1* | 3/2010 | Kaplan et al. | 60/651 |
| 2012/0131920 | A1* | 5/2012 | Held et al. | 60/650 |
| 2014/0026573 | A1* | 1/2014 | Palmer | 60/649 |

(Continued)

FOREIGN PATENT DOCUMENTS

EP 1998013 A3 * 5/2009

*Primary Examiner* — Thomas Denion
*Assistant Examiner* — Steven D Shipe
(74) *Attorney, Agent, or Firm* — Lucas & Mercanti, LLP

(57) ABSTRACT

The invention concerns an ORC plant (Organic Rankine Cycle) for a conversion of thermal energy into electric energy, that comprises a heat exchange group for the exchange of heat between the thermal carrier fluid and a working fluid destined to feed at least one expander connected to an electric generator. The heat exchanger group comprises in succession at least one primary heater and a primary evaporator respectively for preheating and evaporation of the working fluid. According to the invention, on the side of the heat Exchange group, downstream of the primary heater, are present at least an auxiliary evaporator to evaporate a part of the working fluid by means of a heat exchanger with the fluid source coming from the output of said primary evaporator, a device for diverting said part of the working fluid flow from the outlet of said primary preheater towards the auxiliary evaporator, and a compressor designed to receive the working fluid from the auxiliary evaporator and to increase the pressure up to a level corresponding to a preset pressure level for the induction of the work fluid into the expander.

11 Claims, 4 Drawing Sheets

(56) References Cited

U.S. PATENT DOCUMENTS

2014/0026574 A1* 1/2014 Leibowitz et al. ..... 60/651
2014/0033711 A1* 2/2014 Leibowitz et al. ..... 60/645
2014/0075937 A1* 3/2014 Batscha et al. ..... 60/641.1
2014/0075941 A1* 3/2014 Adachi et al. ..... 60/646

* cited by examiner

FIG. 1
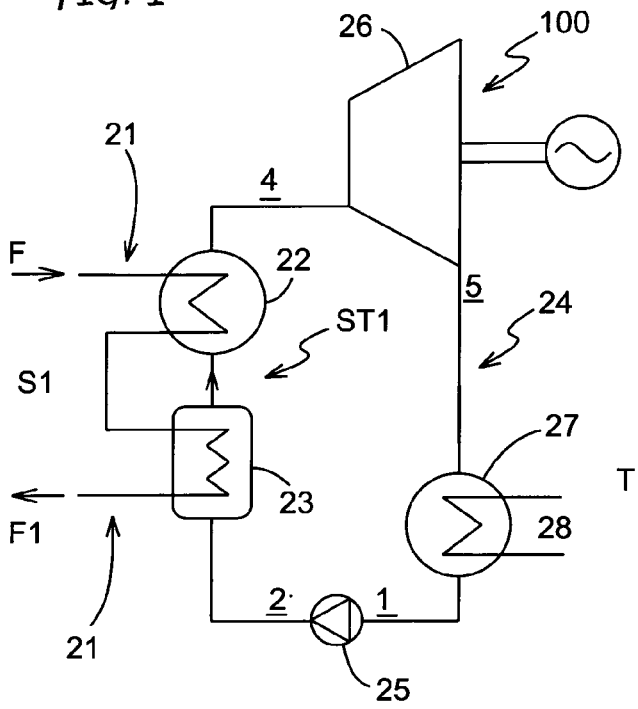
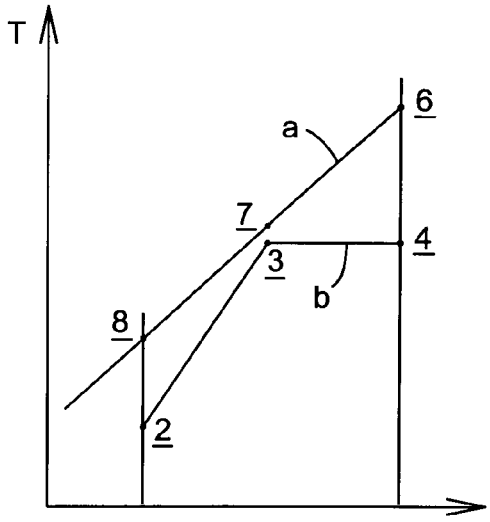
FIG. 3
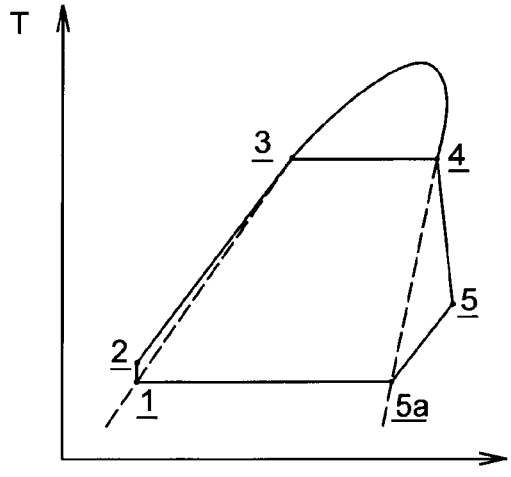
FIG. 2
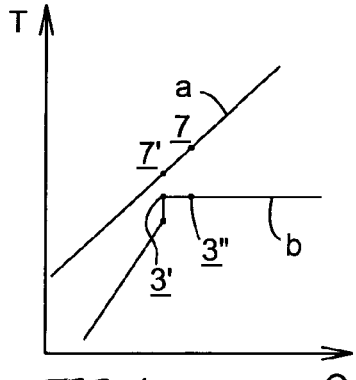
FIG. 4

FIG. 7
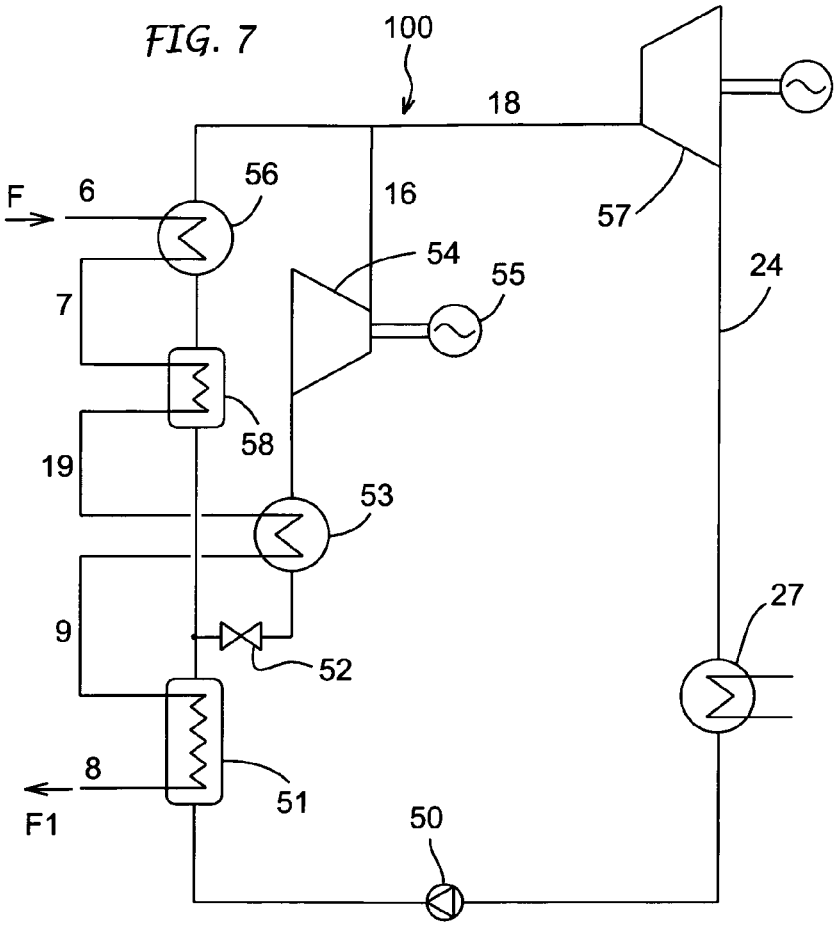
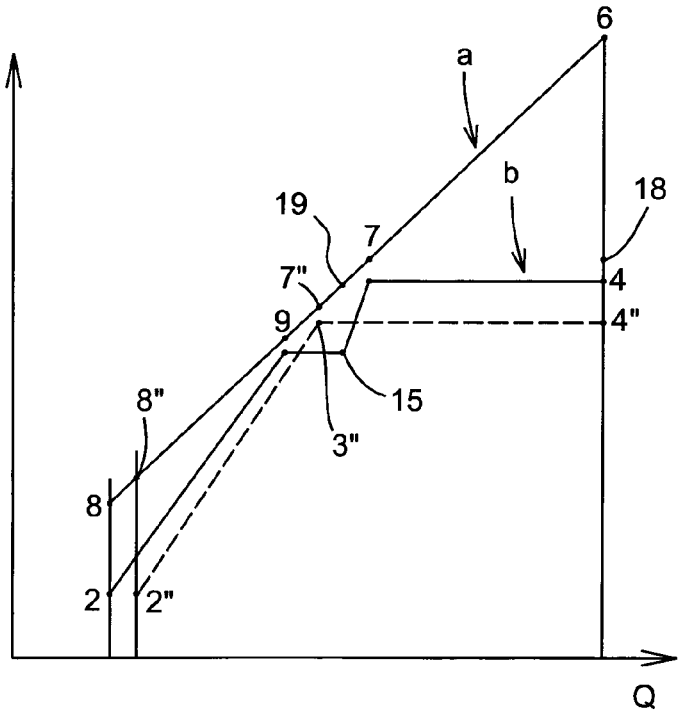
FIG. 8

FIG. 9
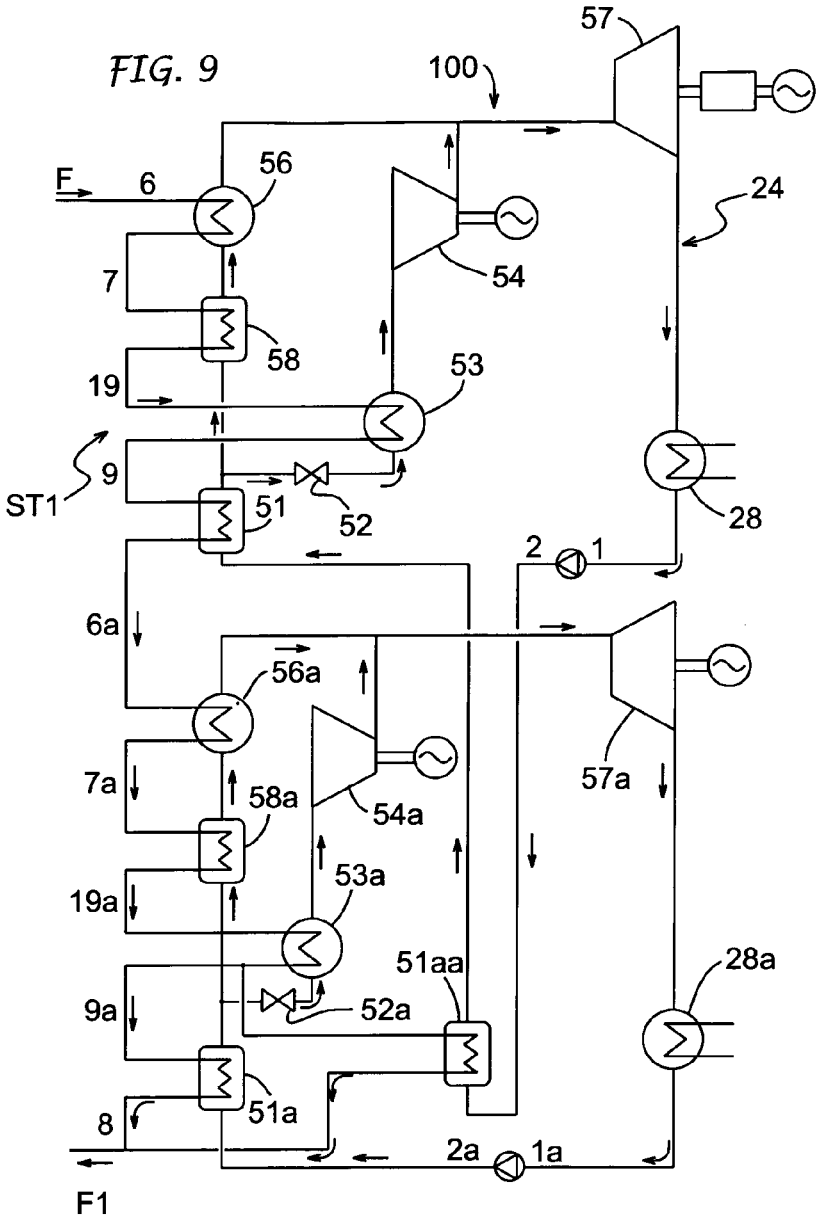
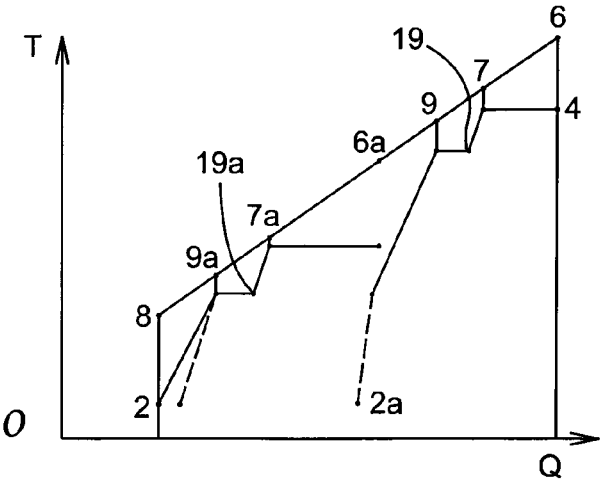
FIG. 10

ORC PLANT WITH A SYSTEM FOR IMPROVING THE HEAT EXCHANGE BETWEEN THE SOURCE OF HOT FLUID AND THE WORKING FLUID

CROSS-REFERENCE TO RELATED APPLICATIONS

This application is a 371 of PCT/IT2011/000190, filed Jun. 9, 2011, which claims the benefit of Italian Patent Application No. BS2010A000105, filed Jun. 10, 2010, the contents of each of which are incorporated herein by reference.

FIELD OF THE INVENTION

The present invention concerns a system for the conversion of thermal energy into electric energy by means of a so-called Organic Rankine Cycle (ORC), where the heating source that supplies the cycle is characterized by a variable temperature and in particular where the intention is to maximize the production of electric energy, deducting from the heating source a thermal power as high as possible in the presence of differences in temperature between the heating source and the work fluid of the cycle reduced as much as possible. The systems using geothermal energy that are fed by liquid geothermal fluid correspond to these requirements, above all in concomitance with a high value of the electric energy produced.

STATE OF THE ART

The typology of the ORC plant the present description refers to is characterized in that it receives the thermal energy for work from a hot source with variable temperature, that is a source made up of a flow of fluid, liquid or gaseous or similar to these (such as a solid in small size opportunely fluidized) that directly or indirectly through an intermediate fluid vector, release heat to the working fluid of the ORC system, thanks to a lowering of its temperature. As an example the hot source can be made up of a flow of liquid geothermal fluid, mainly made up of liquid water with dissolved salts and gas, at a temperature of about 150° C., that transfers to the ORC system a thermal power of some tens of MW, lowering its temperature to a temperature of re-injection in a deep aquifer. The re-injection temperature, except for specific cases, is mainly free, and is therefore advantageous to cool the geothermal fluid as much as possible so as to increase the thermal power taken from the geothermal fluid itself. Other examples can be established in the recovering of heat from industrial process fluids both liquid and gaseous.

In general, the range of the initial temperature of the hot source is typically included between 120 and 300° C., even though it is possible to have lower or higher temperatures, depending on the source fluid (geothermal fluid, heat carrier in the recovery of waste heat in the industry, etc) and also in relation to the working fluid used from case by case in the ORC system, such as for example a Hydrocarbon, a Refrigerant, a Siloxane.

The minimum temperature of the Rankine cycle depends on the available cold source for the condensation of the work fluid. In the description to follow, reference will be made to a cold source in the form of cooling water which can be made available by a cooling tower, therefore with a low side temperature of about 25-30° C. and with such a flow rate as to have a typical increase in temperature in the subtraction of the heat from the cycle around 10° C. However the considerations to follow are applicable in the same way with different cold sources, such as air, or industrial process fluids or heating circuits for ambient heating, greenhouses, or any other low temperature thermal utiliser.

In FIG. 1 of the enclosed drawings is reported a typical scheme of an ORG system 100 dedicated to the above conditions, in a simple version that essentially comprises:

- a thermal source S1 supplying a flow of a thermovector fluid also named a source fluid;
- a primary circuit 21 run through by the source fluid, according to arrows F, F1, mainly moved in circulation by means of at least one pump, not represented in the figure;
- a primary thermal exchange group ST1 that may include an evaporator 22 and a pre-heater 23 for the exchange of heat between the thermovector fluid and a working fluid circulated in a relative circuit 24 by means of a relative pump 25,
- an expander 26, typically made up by a turbine group, fed by the work fluid in exit from the thermal exchange group and followed in general by
- a condenser group 27, in which the condensation heat is transferred, together with an additional heat caused by de-superheating, to a cold source, indicated generically by number 28, mainly constituted by a flow of fluid able to deduct heat, such as water, air or an industrial process fluid.

The thermovector fluid coming from the thermal source S1 then moves along the line 6 towards the evaporator 22, the line 7 between the evaporator 22 and preheater 23 and the line 8 of return to the source S1, while the work fluid is placed in circulation by means of a pump 25 and passes in sequence in the preheater 23, the evaporator 22, the expander 26 and the condensator 27, then returning to the pump.

In an ORC system as represented in FIG. 2 on the thermodynamic diagram Entropy (S) versus Temperature (T), the indicated points which correspond to the homologous points on the system scheme in FIG. 1, have the following meaning:

1. pump inlet
2. pump outlet/start of pre-heating
3. end of pre-heating/start of evaporation
4. end of evaporation/expander outlet
5. expander outlet/condenser inlet
5*a* start of condensation In FIG. 3 is schematized the exchange of heat in the primary thermal exchange group ST1 in a diagram reporting the exchanged thermal power (Q) versus the Temperature (T). The line 6-8, that corresponds to the path of the hot source, that is to say the thermovector fluid, between the inlet of the evaporator 22 and the outlet of the pre-heater 23 of the group ST1 in FIG. 1, represents the transfer of the heat on the part of the heat source and is made up of two branches, where the branch 6-7 represents the thermal power released by the heat source for the evaporation of the working fluid from conditions 3 to conditions 4, and the branch 7-8 represents the thermal power released for the preheating of the liquid work fluid from conditions 2 to conditions 3, correspondingly so also in the diagram in FIG. 2.

The two lines or curves a, b, respectively indicative of the release and the reception of the heat, are characterized by a point, in relation to conditions 3 of the work fluid, in which the two curves are close between them and the difference in temperature T7-T3 between the heat releasing fluid and the heat receiving fluid becomes lower compared to the other points of the transfer diagram. This point is conventionally called "Pinch Point".

It is known, in reality, that practically it is not possible to obtain at point 3 of the end of pre-heating a temperature of the working fluid coincident with the saturated liquid condition. In fact, in general the point 3 will correspond to a slightly lower temperature than the thermovector fluid and, at least in a frequent case that the successive evaporation takes place in an evaporator through a strong mixing of the fluid content; the b curve of the behaviour of the receiving fluid can be indicated as the broken line represented in FIG. 4. In this case, the evaporation becomes extended for a section 3'-3" that represents an introduction of residual thermal power required for pre-heating up to saturation, but with a reception temperature that, thanks to the mixing, it can be considered identical to the evaporation temperature. These phenomena tend to reduce even more the value of the difference in temperature of the "Pinch Point".

For simplicity, in the description to follow, this aspect will not be taken into consideration, which moreover tends to intensify the effects of "Pinch Point", and the transformation will be assimilated to the one represented in FIG. 3, that is with the point 3 of the end of pre-heating and the start of the evaporation of the work fluid coincident.

OBJECTIVE OF THE INVENTION

The presence of a "Pinch Point", in which the heat release curve a and the heat receiving curve b getnear, causes that even a large increase, of the thermal exchange surface between the two fluid currents, respectively the source fluid and the working fluid, does not move forward towards a significant increase in the thermal power subtracted from the heat source.

Taking as a reference for clarity the hypothesis to confront systems with equal evaporation temperatures, if a first system has a modest temperature difference value of "Pinch Point", for example equal to a 2° C., a second system even with a very large increase of the exchange surface compared to the first system, may reduce this difference of an amount, lower however to the same difference in the first system. For example the reduction may be equal to 1° C. The effect of an increase in the thermal exchange surface on the quantity of heat transferred is therefore modest. In reality the effect may be even negligible, for the difficulty indicated above to drop to very low values of the Pinch Point temperature difference.

The objective of the invention is on the one hand to overcome the problem exposed above through an elision of the "Pinch Point" and, on the other hand, to obtain a real benefit in order to subtract more heat by the adoption of larger exchange surfaces, even in presence of small values of difference in temperature of the "Pinch Point".

The objective is reached in accordance with the invention with an ORC plant according to the preamble of claim 1 and furthermore comprising on the side of the thermal exchange group downstream of the primary pre-heater:

- an auxiliary evaporator for an evaporation of a part of work fluid by means of a thermal exchange with the source fluid coming from the primary evaporator,
- a means for deviating said part of the work fluid flow from the output of said preheater towards the auxiliary evaporator;
- a compressor designed to receive the work fluid of said auxiliary evaporator and to raise its pressure up to a value corresponding to a pre-established value at the entrance in said expander.

In particular, the means for deviating a part of the flow of the work fluid from the output of the primary preheater to the auxiliary evaporator can be constituted by a lamination valve and the compressor can be driven by a respective electric motor.

Preferably, the evaporated working fluid coming from the auxiliary evaporator and compressed by the auxiliary compressor is fed to the expander through the same admission duct as the evaporated fluid flow coming from the primary evaporator.

As an alternative however, the vapour of the work fluid supplied by the primary evaporator and the vapour of the work fluid supplied by the auxiliary evaporator can be introduced separately in the expander.

Furthermore, considering the main stream of the work fluid flow, between the primary preheater and the primary evaporator a further preheater can be provided in which the source fluid releases heat to the working fluid before its input in the primary evaporator with the advantage of a further increase of the thermal power taken from the source fluid and, therefore, of a greater electric power produced.

It should be understood that the invention is equally applicable to ORC installations where a first expander and a second expander can be provided, both using the same source fluid and the same work fluid, but operating with different evaporation temperatures through a diverse management of the work fluid flow.

In any case, an ORC installation reconfigured according to the present invention consents in this way an elision of the "Pinch Point" in the primary thermal exchange group or better a substitution of the traditional "Pinch Point" as defined above with at least two "Pinch Points" separated by a cession of heat between the source fluid—though at a lower temperature—and the work fluid, with the final result of consenting a more efficient subtraction of heat to the source fluid.

BRIEF DESCRIPTION OF THE DRAWINGS

The invention will be explained better in the continuation of the description made starting from FIGS. 1 to 4, previously described in relation to the state of the art, and with reference to the further enclosed drawings, in which:

FIG. 7 shows a variation to the ORC system in FIG. 5;

FIG. 8 shows a thermal exchange diagram achieved in a system as shown in FIG. 5;

FIG. 9 shows a scheme of an ORC system integrating the invention in the presence of two expanders with different evaporation temperatures; and FIG. 10 shows a thermal exchange diagram carried out in a system such as is shown in FIG. 9.

In these other drawings the same reference numbers are used in the same way as in FIG. 1, where applicable, to indicate parts or components, equal or similar to those schematized in FIG. 1, omitting, however, as was carried out also in the same FIG. 1, valves, pumps and those habitual accessories that usually complete and ensure the operation of an ORC system.

DETAILED DESCRIPTION OF THE INVENTION

Figure 5:
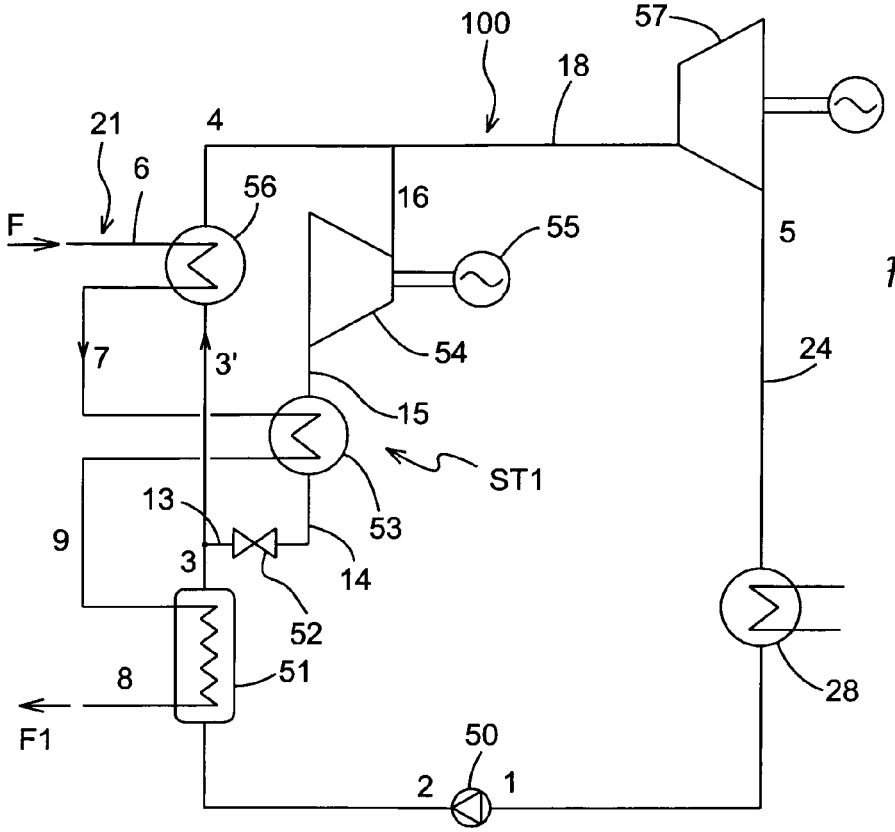
FIG. 5 shows an ORC scheme system with a single expander, integrating the means for an elision of the "pinch point"
Figure 6:
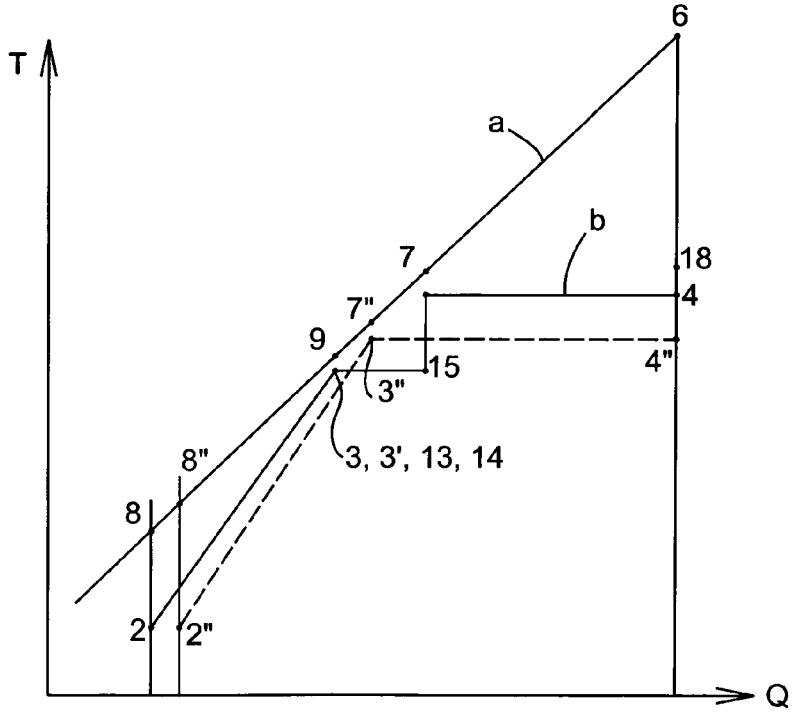
FIG. 6 shows a diagram of a thermal exchange equivalent to the one in FIG. 3, but reached in a system as schematized in FIG. 5.

With particular reference to FIGS. 5 and 6, an ORC system 100 according to the invention comprises, on the part of the thermal primary exchange group ST1, a primary preheater 51 by means of which the thermovector fluid coming from a hot source S1 heats the work liquid fluid from temperature 2 to temperature 3, downstream of a pump 50 designed for the circulation of the work fluid in the power circuit 24.

Downstream of said primary preheater 51 the work fluid flow is divided into two streams, with a first stream 3 directed to a primary evaporator 56 and a second stream 13 direct to an auxiliary evaporator 53. In particular, this second working fluid flow 13 is laminated through a valve 52 to carry the pressure at the level in force in the auxiliary evaporator 53. The capacity of the second work fluid flow 13 so separated gets evaporated in this auxiliary evaporator 53 and, through a conduit 15, is fed to a compressor 54 driven by a motor 5, in which the pressure of the work fluid is raised up to the necessary value so as to consent to the admission in an expander 57, preferably through the same conduit 18 that receives and transfers to the expander the main work fluid flow of the evaporation in the evaporator 56.

The source fluid that heats the work fluid passes in succession in the exchanger 56, 53, 51 of the primary thermal exchange group ST1 moving in sequence the lines 6, 7, 9, 8. In the representation on the Temperature (T) versus the Thermal power exchanged (Q) diagram in FIG. 6 they are recognised in sequence on the side of the working fluid:

- at point 2 the input temperature at the primary preheater 51 of the full flow of work liquid fluid;
- at point 3 the temperature of the work fluid immediately downstream of the primary preheater 51, basically coincident with the temperature at point 13 and hardly dissimilar (even if represented as coincident) from the temperature at point 14, namely upstream and downstream of the lamination valve 52;
- at point 15 the temperature at the end of the evaporation of the separated flow directed to the auxiliary evaporator 53, the difference between the abscissae of point 15 and of point 3 representing the evaporation thermal power;
- at point 4 the exit condition of the working fluid from the evaporator 56;
- at point 18 the input condition of the work fluid in the expander in the case in which the two main flows 4 and auxiliary 16, respectively coming from the primary evaporator 56 and from the compressor 54, are mixed between them.

Really, the actual conditions in 18 will depend on the efficiency of the compressor and on its level of adiabaticity; principally as the compressors are basically adiabatic and necessarily with efficiency lower than the unit, the point 18 will probably be at an higher temperature than point 4, however there may also be different cases, for example in case the fluid in condition 4 happens to be superheated.

The exchanged thermal powers are represented by the differences in the abscissa values from 6 to 7, for the primary evaporator 56, from 7 to 9 for the auxiliary evaporator 53, from 9 to 8 for the pre-heater 51.

In the diagram in FIG. 6 is also brought again a broken line 2", 3", 4" that represents an hypothetic ORC system, for example, according to the state of the art in FIG. 1, therefore without the auxiliary evaporator 53 and compressor 54 as provided by the present invention, and with an intermediate evaporation temperature between those of the auxiliary 53 and primary evaporator 56.

Therefore, in an ORG installation incorporating the present invention, the traditional system with a single "Pinch Point" in 7", a system with two "Pinch Points" separated from a transfer of heat, has been substituted with the final result of allowing a more efficient deduction of heat, represented in FIG. 6 by passing from the subtraction of a thermal power equivalent to the difference of the abscissae of points 6 and 8" (the last corresponding to point 2"—on the broken line—of a traditional ORC system), to a corresponding thermal power corresponding to the difference of the abscissae of points 6 to 8—on the continue line.

Evidently this increase in thermal power entering in the ORG system corresponds to an increase of produced electric power, and though this increase takes place at the cost of an increase of exchange surfaces and of an increase of the consumption of energy on the part of the auxiliaries for the work of the compressors, the final balance however becomes positive compared to a traditional ORC system.

In a variation of the invention as shown in FIG. 7, downstream of the primary preheater 61 considering the main direction of the work fluid flow, correspondingly upstream of the primary evaporator 56, a further preheater 58 is inserted, in which the source fluid releases heat from point 7 to point 19, reported equally on the Temperature (T)—Thermal Power Exchanged (Q) diagram in FIG. 8.

While in the embodiment in FIG. 5, this same heat was introduced inside the evaporator, therefore becoming included in the heat released along the path of line 6-7 in FIG. 6, in the version of the ORC system as in FIG. 7, such heat corresponds to a further increase of the thermal power (7-19, FIG. 8) subtracted from the source fluid and, therefore, at a greater increase in the electric power produced.

FIG. 9 and the Temperature (T)—Thermal Power Exchanged (Q) diagram in FIG. 10 refer to the application of the same inventive concept to the case of a ORC system characterised in that it comprises besides an expander 57 also a second expander 57*a*, where both the expanders use the same source fluid and the same work fluid, but operate with different evaporation temperatures.

In this execution, the components of the primary thermal exchange group ST1 between the source fluid and the work fluid of the power circuit 24 correlated to the first expander 57 are completely analogous to those described in relation to the embodiment in FIG. 7 and therefore are indicated with the same reference numbers. The components of the thermal exchange group between the source fluid and the work fluid, and the correlated power cycle to the second expander 57*a* are assimilable to those correlated to the first expander 57 and are indicated with the same reference numbers but with the addition of "a".

The two expanders 57, 57*a*, therefore, are transversed by work fluid flows that receive thermal power from the source fluid with a set course in series except for what concerns the preheaters 51*a*, 51*aa* that are positioned in parallel on the flow of the source fluid. This solution, comprising at least one but preferably two elision systems of the "Pinch Point" as shown in FIG. 10, permit a thermal exchange between source fluid and work fluid with small differences in temperature and an efficient subtraction of heat from the source to a temperature close to the condensation temperature.

In the description that precedes only the most relevant exchanges of heat have been reported and discussed for the application of the invention. However the invention can be efficiently applied even in the in presence of other exchangers, in particular for applications with high temperatures, such as one or more regenerators downstream of the expander or of each expander, heat exchangers for the preheating at the cost of an external thermal source of a part of the liquid in parallel in regards to the regenerator itself, according to a technique known with the name of "split".

The invention claimed is:

1. An ORC system (Organic Rankine Cycle) for the conversion of thermal energy into electric energy, comprising:

a heating source that supplies a hot source fluid, a primary circuit in which flows the hot source fluid coming from said heating source, a heat exchange group for an exchange of heat between the hot source fluid and a work fluid circulating in a relative working fluid circuit by means of a first pump, where said heat exchange group comprises in succession a first primary preheater and a first primary evaporator respectively for preheating and evaporating of the work fluid, a first expander fed in input by the work fluid exiting from said heat exchange group and connected to a first electric generator, and a first condenser connected on the one hand directly or indirectly to an output of the work fluid from said first expander and on the other hand to an input of said first pump, a first auxiliary evaporator to evaporate one part of the work fluid through a heat exchanger with the hot source fluid coming from an output of said first primary evaporator, a first means for diverting said part of the flow of the work fluid from an outlet of said first primary preheater towards the first auxiliary evaporator, and a first compressor configured to receive the work fluid from said first auxiliary evaporator, and to increase a pressure up to a level corresponding to a preset pressure level for the induction of the work fluid into said first expander.

2. The ORC System according to claim 1, in which the first means for diverting the part of the flow of the work fluid from the output of the first primary evaporator to the first auxiliary evaporator includes a valve used to direct the work fluid so that the pressure of said work fluid reaches the level of the pressure in the first auxiliary evaporator.

3. The ORC System according to claim 1, in which the work fluid exiting from the first auxiliary evaporator in the form of vapour and compressed by the first compressor is fed to the first expander together with the flow of fluid in the form of vapour coming from the first primary evaporator, using the same conduit.

4. The ORC System according to claim 1, in which the work fluid exiting from the first auxiliary evaporator in the form of vapour and compressed by the first compressor is fed to the first expander separately from the flow of fluid in the form of vapour coming from the first primary evaporator using separate conduits.

5. The ORC System according to claim 1, in which the heat exchange group includes a second preheater inserted between the first primary preheater and the first primary evaporator to exchange additional heat between the source fluid and the work fluid before it enters said first primary evaporator.

6. The ORC System according to claim 5, in which the first means for diverting a part of the flow of work fluid from the primary heat exchange group towards the first auxiliary evaporator is connected to the output of the first primary preheater.

7. The ORC System according to claim 1, where the system further comprises a second expander using the hot source fluid and a second work fluid, where the second work fluid is the same work fluid as the work fluid of the first expander but working at different evaporation temperatures, in which the second expander is provided with, a second primary preheater, a second line auxiliary evaporator for evaporating a part of the second work fluid using a heat exchange with the hot source fluid, a second line means for diverting a part of the flow of second work fluid from the output of the second primary preheater towards the second auxiliary evaporator, and a second compressor designed to receive the second work fluid from said second auxiliary evaporator and to raise a pressure until it reaches a level corresponding to a preset pressure level for the introduction of the second work fluid into said second expander, wherein the first auxiliary evaporator and the second auxiliary evaporator are placed in series with respect to the flow of the hot source fluid, and a further primary preheater is positioned in parallel to the second primary preheater with respect to the flow of the hot source fluid.

8. A method for improving the exchange of heat between a hot source fluid and a work fluid in particular in an ORC plant (Organic Rankine Cycle) for the conversion of thermal energy into electric energy, where said heat exchange takes place in a thermal exchange group that comprises at least one primary pre-heater and a primary evaporator in succession respectively for preheating and evaporation of the work fluid to be fed to an input of at least one expander working in conjunction with an electric generator and having an output connected to a condenser, comprising:

collecting a part of the work fluid in liquid form from said thermal exchange group on a flow line between the at least one primary pre-heater and the primary evaporator, conducting the part of the collected work fluid to the input of an auxiliary evaporator to evaporate said part of the work fluid by undergoing a heat exchange with the source fluid that comes from the output of said primary evaporator, and supplying the work fluid that exits as vapour from said auxiliary evaporator to a compressor designed to increase a pressure until it reaches a level corresponding to a preset level for the emission of the work fluid into said at least one expander, feeding the work fluid in the form of compressed vapour to said at least one expander.

9. The method according to claim 8, wherein, in the step of feeding, the work fluid in the form of compressed vapour is fed by said compressor to the expander together with the work fluid coming from the primary evaporator.

10. The method according to claim 8, wherein, in the step of feeding, the work fluid in the form of compressed vapour is fed by said compressor to the expander separately from the work fluid coming from the primary evaporator.

11. The method according to claim 8, further comprising an additional exchange of heat between the source fluid and the work fluid before the input of the latter into the primary evaporator conduit in a second pre-heater inserted between the at least one primary pre-heater and the primary evaporator.

* * * * *